United States Patent [19]

Tanaka

[11] 4,050,264

[45] Sept. 27, 1977

[54] REFRIGERATING CONTAINER

[75] Inventor: Mikio Tanaka, Kyoto, Japan

[73] Assignee: Makoto Takugyo Kabushikikaisha, Kyoto, Japan

[21] Appl. No.: 709,404

[22] Filed: July 28, 1976

[30] Foreign Application Priority Data

Aug. 4, 1975 Japan ..... 50-108510[U]

[51] Int. Cl.[2] ..... F25D 3/08

[52] U.S. Cl. ..... 62/457; 62/371; 62/530

[58] Field of Search ..... 62/529, 530, 370, 371, 62/457; 220/9 R

[56] References Cited

U.S. PATENT DOCUMENTS

| | | | |
|---|---|---|---|
| 2,289,254 | 7/1942 | Eagles | 220/9 R |
| 2,673,454 | 3/1954 | Gallie et al. | 62/371 |
| 3,387,650 | 6/1968 | Hoffmann et al. | 62/371 |
| 3,452,469 | 7/1969 | White | 62/372 |
| 3,807,194 | 4/1974 | Bond | 62/371 |

*Primary Examiner*—Lloyd L. King

*Attorney, Agent, or Firm*—Browdy and Neimark

[57] ABSTRACT

In a refrigerating container of the present invention, an inner lid with freezing material is slidably and closely engaged in the inside wall of an inner box, the inner lid and the inner box being made of closed-cellular synthetic resin foam. The inner lid is pressed down to touch the contents to minimize the space between the inner lid and the contents and to increase freezing effect.

9 Claims, 2 Drawing Figures

REFRIGERATING CONTAINER

DETAILED DESCRIPTION OF THE INVENTION

The present invention relates to a portable refrigerating container.

There have been refrigerating containers which are integrally incorporated an inner container made of ordinary heat insulating material with an outer container, or have two or three layers of ordinary heat insulating material to increase refrigerating effect. However, the former requires unnecessary work to carry the whole, when the contaminated inside of the container is washed away, and the latter is inconvenient to carry, owing to its increased weight.

Further, the both cannot be adjusted the space between the lid and the contents, whereby refrigerating effect decreases, when the contents are small.

An object of the present invention is to solve the above problems.

Referring to the drawings, a peferred embodiment will be described as follows, wherein.

Figure 1:
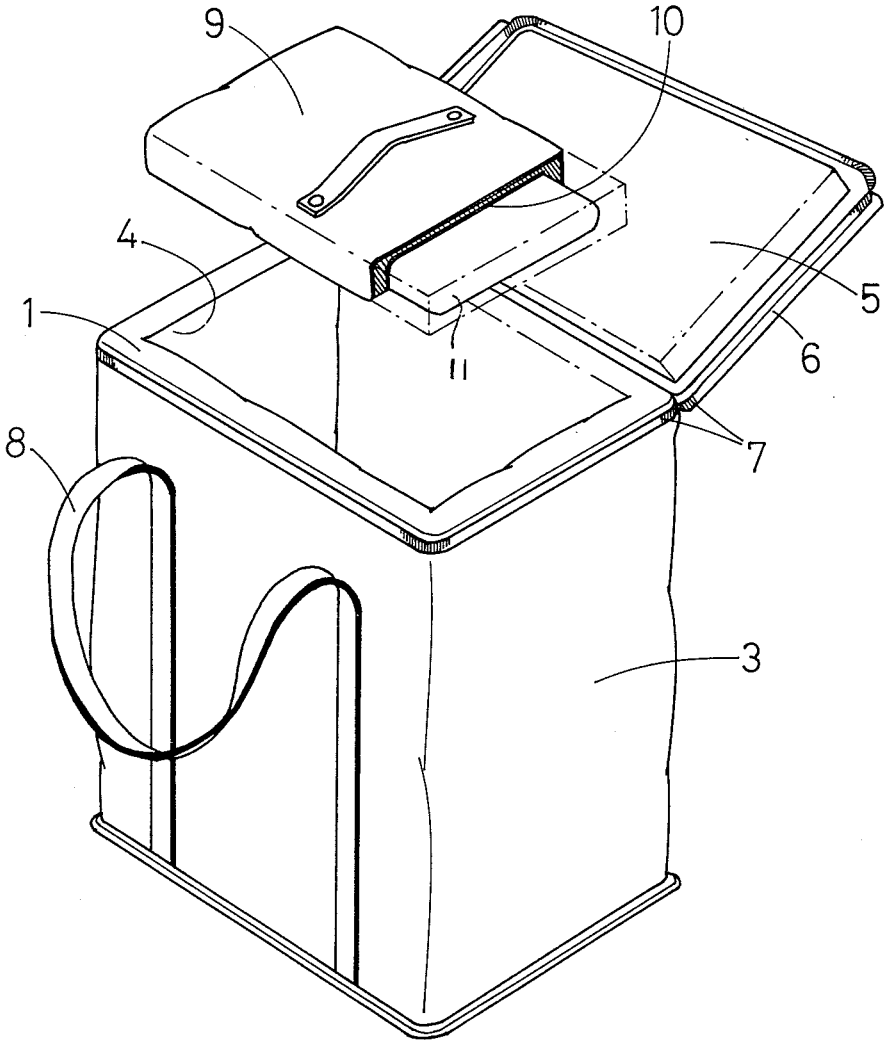
FIG. 1 is a perspective view of the refrigerating container.
Figure 2:
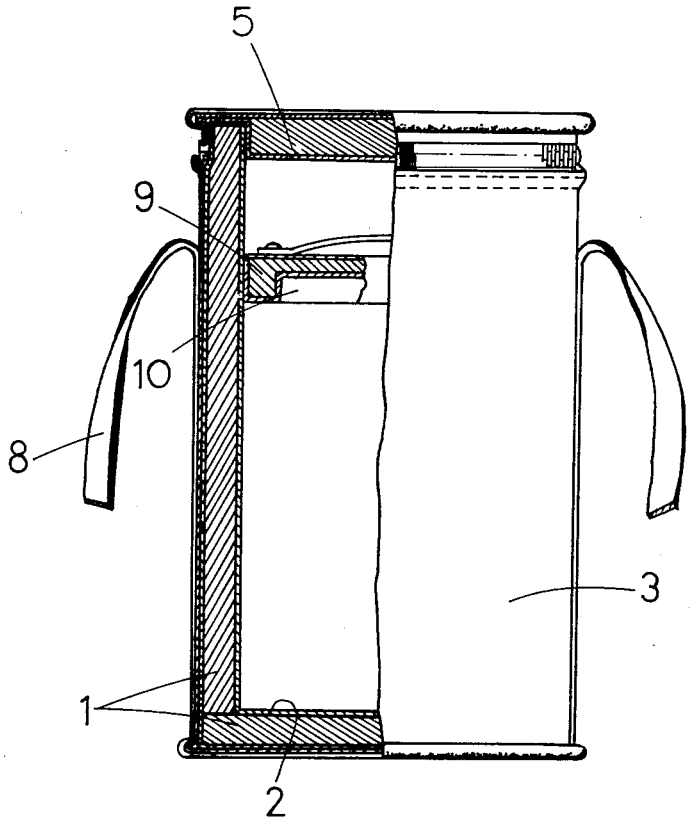
FIG. 2 is a side view partly in section thereof.

Numeral 1 is an inner box made of heat insulating material such as closed-cellular synthetic resin foam, which is closely covered with synthetic resin film 2. Numeral 3 is a bag which removably contains the inner box 1. A covering lid 6, provided with a lid 5 to close an upper opening 4 of the inner box 1, is provided on the top end of one side wall of the bag 3, and a fastener 7 is provided to close the bag 3 and the covering lid 6. Numeral 8 is carrying straps oppositely provided on the side walls of the bag 3. Numeral 9 is an inner lid made of the same closed-cellular synthetic resin foam as the inner box 1 and the lid 5, which is slidably and closely engaged in the inside wall of the inner box 1. The inner lid 9 has a depression 10 on the opposite side to the bottom of the inner box 1, where a freezing material 11 is removably held.

The closed-cellular synthetic resin foam used in the present invention consists of light and strong polyethylene, which is excellent in heat insulating property, buffer property, weathering-resistance, and chemical-resistance, and is easily subjected to processes such as heat-molding and adhesion to other materials.

After the covering lid 6 and the lid 5 are opened from the upper opening 4 of the inner box 1 by opening the fastener 7, and the inner lid 9 is removed from the inside wall of the inner box 1, frozen foods such as fishes and meat, which are required freezing, are put in the inner box 1. The freezing material 11 is previously cooled in refrigerator and is held in the depression 10 of the inner lid 9. The inner lid 9 is engaged in the inside wall of the inner box 1, and pressed down to touch the frozen foods. Then, the covering lid 6 is closed.

The inner box, the lid, and the inner lid are made of closed-cellular synthetic resin foam which has very high heat insulating property. The inner box has a double lid structure consisting of the lid and the inner lid. The inner lid, holding the freezing material, is slidably and closely engaged in the inside wall of the inner box. Therefore, the space between the inner lid and the contents can be minimized to increase freezing effect, even when few foods are put in the inner box.

The refrigerating container of the present invention is very light and is convenient to carry. The inner box can easily be removed from the bag to wash away and to keep always clean.

What is claimed is:

1. A portable refrigerating container comprising, in combination:

a bag member having outwardly facing side walls;

carrying straps fixed to said side walls;

an inner box removably positioned within said bag member, said inner box having an opening at one end thereof and inwardly facing inner side wall means defining a storage chamber having a given horizontal cross-sectional configuration along at least a substantially portion of its height;

a covering lid pivotally fastened to said bag member along a top, side edge thereof;

a lid member fixed to said covering lid for closing said opening at one end of said inner box when said covering lid is in its closed position; and an inner lid slidably and closely engaged with said inner side wall means, said inner lid having a recess therein for holding cooling material;

whereby material to be refrigerated may be stored in the storage chamber to variable levels and the inner lid with the cooling material therein can be slid downwardly within the chamber and be positioned in contact with the material in the chamber.

2. A portable refrigerating container according to claim 1, wherein said inner box, said lid member and said inner lid are made of heat insulating material.

3. A portable refrigerating container according to claim 1, wherein said storage chamber has said given horizontal cross-sectional configuration along its entire height.

4. A portable refrigerating container according to claim 3, wherein said inner box, said lid member and said inner lid are made of heat insulating material.

5. A portable refrigerating container according to claim 1, wherein said inner side wall means comprise four inner side walls and define a storage chamber having a given horizontal cross-sectional configuration along at least a substantial portion of its height which is rectangular.

6. A portable refrigerating container according to claim 5, wherein said inner box, said lid member and said inner lid are made of heat insulating material.

7. A portable refrigerating container according to claim 5, wherein said storage chamber has said given horizontal cross-sectional configuration along its entire height.

8. A portable refrigerating container according to claim 7, wherein said inner box, said lid member and said inner lid are made of heat insulating material.

9. A portable refrigerating container according to claim 1, wherein said inner box, said lid member and said inner lid are made of closed-cellular synthetic resin foam.

* * * * *